US007578106B2

(12) United States Patent
Burns et al.

(10) Patent No.: US 7,578,106 B2
(45) Date of Patent: Aug. 25, 2009

(54) WALL MOLDING FOR SUSPENDED CEILING

(75) Inventors: Garry W. Burns, Chapin, SC (US); Alan C. Wendt, Barrington, IL (US); Martin E. Likozar, Richmond Heights, OH (US)

(73) Assignee: USG Interiors, Inc., Chicago, IL (US)

( * ) Notice: Subject to any disclaimer, the term of this patent is extended or adjusted under 35 U.S.C. 154(b) by 882 days.

(21) Appl. No.: 10/887,190

(22) Filed: Jul. 8, 2004

(65) Prior Publication Data

US 2006/0005493 A1 Jan. 12, 2006

(51) Int. Cl.
*E04F 13/26* (2006.01)

(52) U.S. Cl. ..... 52/506.06; 52/716.1; 52/506.07

(58) Field of Classification Search ..... 52/506.01, 52/506.05–506.1, 716.1
See application file for complete search history.

(56) References Cited

U.S. PATENT DOCUMENTS 3,417,530 A * 12/1968 Long ..... 52/506.08
4,010,591 A * 3/1977 Gross ..... 52/716.1
6,138,425 A * 10/2000 Wendt ..... 52/506.07
6,918,212 B1 * 7/2005 Anderson, Sr. ..... 52/506.05

OTHER PUBLICATIONS

USG Moldings and Accessories, 15 pages, undated.
Armstrong Ceiling System Moldings and Accessories, 2 pages, copyright 2003 Armstrong World Industries, Inc.
CMC Wall Angles, p. 12, undated.
USG System components—perimeter trims, pp. 42 and 43, undated.

* cited by examiner

*Primary Examiner*—Richard E Chilcot, Jr.
*Assistant Examiner*—Matthew J Smith
(74) *Attorney, Agent, or Firm*—Pearne & Gordon LLP

(57) ABSTRACT

A seismic wall molding for suspended ceiling systems that, although sufficiently wide across its horizontal ceiling supporting leg, is visually unobtrusive by virtue of a stepped, shadow style configuration. The stepped horizontal leg configuration allows the wall molding to resist buckling or bending deformation in the horizontal leg when a vertical leg of the molding is tightly secured against a non-flat wall surface. Factory ends on the wall molding are at parallel 45 degree planes to facilitate making inside and outside corners at the job site. A factory supplied template simplifies corner construction. A splice piece fits tightly on the upper sides of the horizontal legs at a straight-line joint between abutting lengths of the wall molding to maintain these elements in alignment.

16 Claims, 5 Drawing Sheets

WALL MOLDING FOR SUSPENDED CEILING

BACKGROUND OF THE INVENTION

The invention relates to suspended ceiling structures and, in particular, to improvements in perimeter trim for suspended ceiling systems.

PRIOR ART

Suspended ceiling systems of the type comprising a rectangular grid and lay-in tiles ordinarily use wall mounted trim or molding, most commonly in the general form of an angle, to support ends of the grid elements and edges of the tiles. Seismic building standards have evolved that specify that a wall angle or perimeter trim have a relatively wide horizontal leg. This requirement is to ensure that when seismic activity causes the suspended parts of a ceiling to shift horizontally relative to the walls that the elements supported by the wall molding do not slip off the wall molding. With regular perimeter trim of limited width, there is a risk that the ceiling components can slip off the horizontal leg of the trim or molding.

Wide horizontal flanges or legs on a wall molding present problems for the architect and the installer. A wide plain face on the visible horizontal leg is often undesirable for aesthetic reasons including the fact that the trim looks out of proportion to the grid elements of the ceiling. Another sometimes very troublesome problem encountered with wide face trim is distortion of the horizontal leg out of its design plane. This distortion occurs when the vertical leg is secured against a wall that in local areas is not flat. When the vertical leg is drawn tight against a non-flat wall area, particularly where the wall is locally concave, the horizontal leg distorts from its free state. Drywall seams and misaligned or bowed studs and/or improperly set fasteners, all of which in practice may be unavoidable, are typical causes of irregular non-flat wall surfaces. The resulting distortion in the wall molding can be severe enough to render the installation unacceptable if not somehow corrected.

Adding to the difficulties faced by an installer of a suspended ceiling are the problems of creating a gap free and aligned joint between adjacent lengths of wall molding. These problems are particularly acute where the visible face of the horizontal leg is stepped such as found in a so-called shadow-type wall molding.

SUMMARY OF THE INVENTION

The invention provides a perimeter trim or wall molding construction suitable for service in areas where seismic building standards are applicable. The invention solves the problems associated with wide faced horizontal support legs needed to comply with seismic building standards. The perimeter trim of the invention has its horizontal relatively broad supporting leg formed in stepped sections. The relatively broad leg, thus, not only forms shadow lines giving it a less massive appearance, but is also reinforced against the tendency to buckle out of its free state plane.

The stepped configuration of the horizontal leg preferably includes a vertical stiffening portion adjacent the free edge of the leg. This location allows this stiffening portion to provide a proportionately high degree of rigidity and resistance to buckling or other deflection at the free edge where such deflection is typically greatest and most conspicuous.

In accordance with an aspect of the invention, individual pieces or lengths of the wall molding can be factory end cut at a 45 degree angle to facilitate field installation of both inside and outside corners. The factory ends are parallel to one another so that, as disclosed, one or the other end of a piece can be used to form an inside or outside corner, respectively. A factory-provided template enables the installer to quickly hand cut an end of a length of the wall molding to fit the appropriate factory mitered end to form the desired inside or outside corner. A splice can be furnished to assure that at straight end-to-end joints, the visible wide legs are in alignment.

DESCRIPTION OF THE PREFERRED EMBODIMENT

Figure 1:
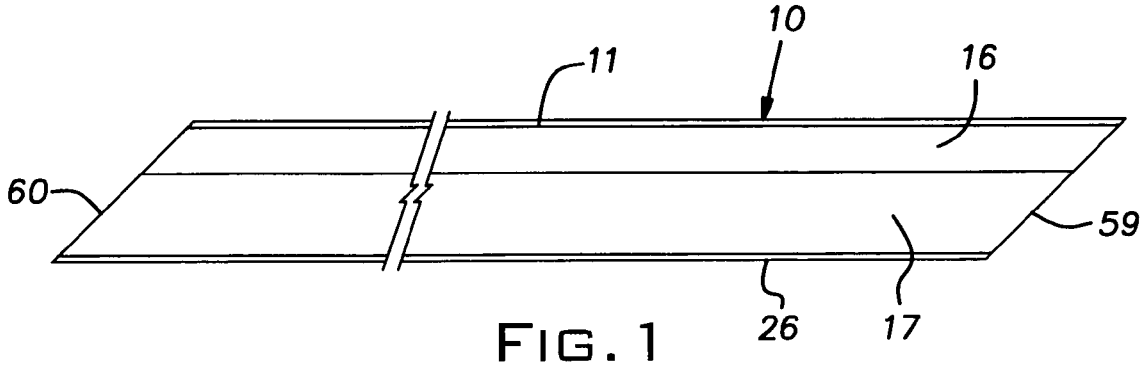
FIG. 1 is a fragmentary plan view of a wall molding constructed in accordance with the invention.
Figure 1A:
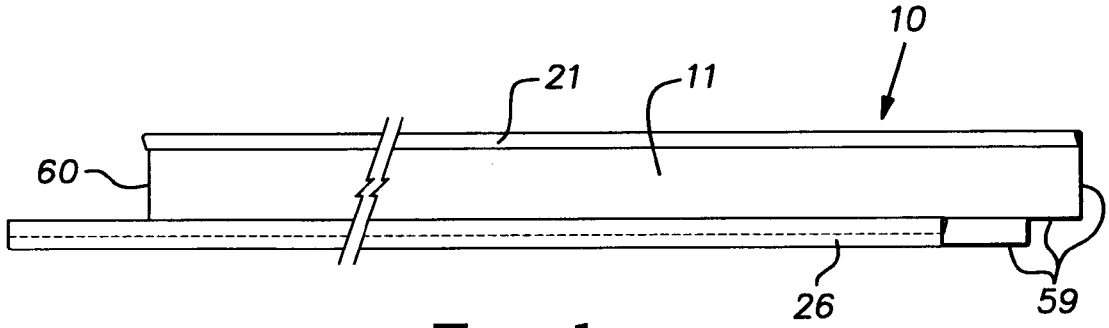
FIG. 1A is a fragmentary elevational view of the wall molding of FIG. 1.
Figure 2:
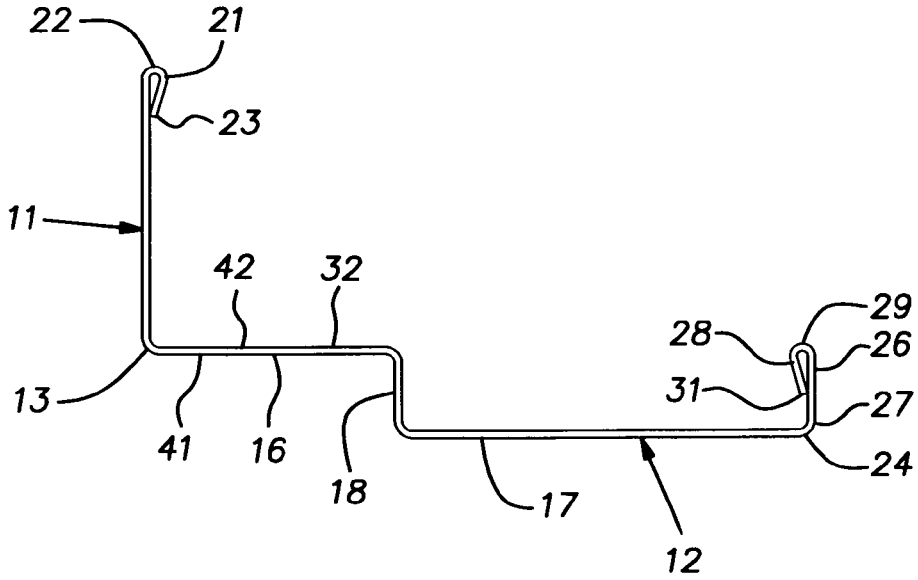
FIG. 2 is a cross-sectional view of the wall molding of FIG. 1 taken at the plane indicated at the lines 2-2 in FIG. 1.

Referring now to the drawings and, in particular, FIGS. 1 and 2, a length or piece of perimeter trim is illustrated at 10. The trim 10, also referred to as wall molding, is preferably made by roll-forming a strip of sheet metal stock into the cross-section illustrated in FIG. 2. Typically, the sheet stock is steel with a thickness of, for example, about 0.021" to about 0.024". Ordinarily, each length or piece 10 of wall molding is 10 feet or 12 feet long (i.e. the length of either longitudinal edge).

With reference to FIG. 2, the wall molding includes a generally flat vertical leg or flange 11 and a generally horizontal leg 12. The legs 11, 12 are integrally joined at a 90 degree corner 13. When the term "horizontal" is used to describe the leg 12, it is used in the general sense to cover parts or elements that extend or exist horizontally away from the wall or corner 13 and are active in supplying directly or indirectly vertical support of the ceiling grid and tiles of a suspended ceiling system. The horizontal leg 12, which in use, as will be discussed, supports adjacent suspended ceiling structure, has two generally horizontal sections 16, 17 and a generally vertical stiffening web 18 extending between and integral with the sections 16, 17. The illustrated sections 16, 17 are unequal in width, but not limited to that, the section 16 adjacent the corner 13 being about ¾" wide and the section distal from the corner being about 1¼" wide. The proportionate width of the sections 16, 17 can be varied as desired, but their combined width should be at least about 2" to satisfy seismic code requirements.

A hem 21 is formed on an upper edge 22 of the vertical leg 11 distal from the corner 13 by folding the sheet material back on itself to reinforce this edge. The hem 21 is sufficiently folded so that an actual edge 23 of the sheet stock contacts the vertical leg 11 at a line below the upper edge 22.

Adjacent a free edge 24 of the horizontal leg section 17, the horizontal leg 12 includes a vertical stiffening flange or element 26. The stiffening flange 26 is integrally joined to the leg section 17 at a 90 degree corner 27 and has a hem 28 at its upper edge 29. The sheet material of the hem 28 is folded back so that its actual edge 31 contacts the stiffening flange 26 at a line below the stiffening flange edge 29. The free edge 29 of the stiffening flange 26 is preferably at least at the elevation of an upper face 32 of the horizontal leg section 16 proximal to the corner 13. The various parts of the wall molding 10 described with reference to FIG. 2 extend longitudinally for the length of the wall molding.

Figure 9:
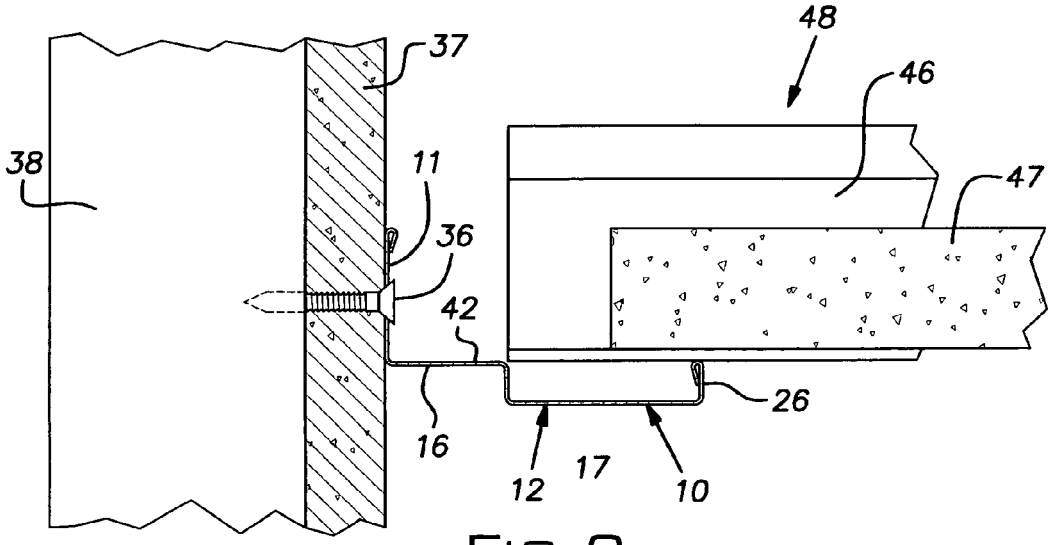
FIG. 9 is a fragmentary cross-sectional view in a vertical plane of a suspended ceiling system employing the wall molding of the invention.

The wall molding or perimeter trim 10, in a conventional manner, is secured to a wall 37 with suitable fasteners 36, such as screws, nails or staples at the desired plane of the ceiling. As shown in FIG. 9, the vertical leg 11 is held tightly against the wall 37 by fasteners 36 driven into a structural wall member 38 such as a metal or wood stud, or a monolithic wall.

When conventional wall moldings with wide seismic rated horizontal legs are installed on non-flat walls, these legs are prone to severely distort out of their free state shape particularly when the geometry of the wall is locally concave. The disclosed wall molding or trim piece 10 has demonstrated a high level of resistance to this kind of distortion. One factor contributing to this desirable characteristic is the vertical flange or rib 26 that stabilizes the outer or distal horizontal leg or face section 17. Preferably, as mentioned, the flange 26 stands at least as tall as the difference in elevation between the horizontal leg sections 16, 17. In one arrangement, the vertical leg 11 has a height measured from the plane of a lower face 41 of the proximal horizontal leg section 16 to the upper edge 22 of ⅞" or 1" while the height of the vertical flange 26 is about 9/32" (nominally 0.274") where the difference in elevation between the horizontal leg sections 16, 17 is nominally ¼" and the material thickness is between about 0.021" to 0.024". Stated in other words, the height of the vertical flange 26 is preferably more than ¼ of the height of the vertical leg 11 and can be less than ⅓ of the height of the vertical leg when the vertical leg is ⅞" tall.

For appearance, it is important that the free edge of the distal section 17 of the horizontal leg at the corner 27 remains as flat or straight as possible in the lengthwise direction. Flatness at this location by avoiding any buckling or bending distortion from the free state flat condition of the wall molding 10 is important because this is the area of the molding that is most conspicuous when distortion occurs. While the exact phenomena is not known, it is believed that the superior resistance to buckling or other distortion at the free edge 24 of the horizontal leg section 17 is attributable to two stages of vertical stiffening elements, namely, the vertical web 18 and the vertical flange 26. Propagation of strain into the outer or distal horizontal leg section 17 is reduced by the existence of the web 18 which serves to resist vertical buckling in the horizontal leg and which, in a bellows-like effect, reduces the transmission of horizontal strain imposed on the molding 10, when its vertical leg 11 is drawn against a non-flat wall area, between the horizontal leg section 16 adjacent the vertical leg 11 and the distal horizontal leg section 17.

The illustrated cross-sectional form of the wall molding 10 is beneficial for additional reasons with the vertical flange 26 extending substantially at least as high as an upper face 42 of the inner or proximal horizontal leg section 16, tees 46 and ceiling tiles 47 of a suspended ceiling system 48 (FIG. 9) can rest on the vertical flange 26 and be free to slide over this upper face during seismic activity. The spacing of the vertical web 18 from the vertical leg 11 is nominally about ¾" so that it can be used by an installer as a gauge to measure the required clearance as required by the applicable seismic building code. Where tees 46 are anchored to the wall molding 10, the tees extend over the proximal section 16. Pop rivets or screws through the section 16 and ends of the tees 46 are advantageously somewhat hidden from view by the vertically recessed character of this section. Similarly, the distal section 17, by virtue of being lower than the section 16 and the corner 13 serves somewhat to conceal gaps between the molding 10 and wall 37.

Figure 7A:
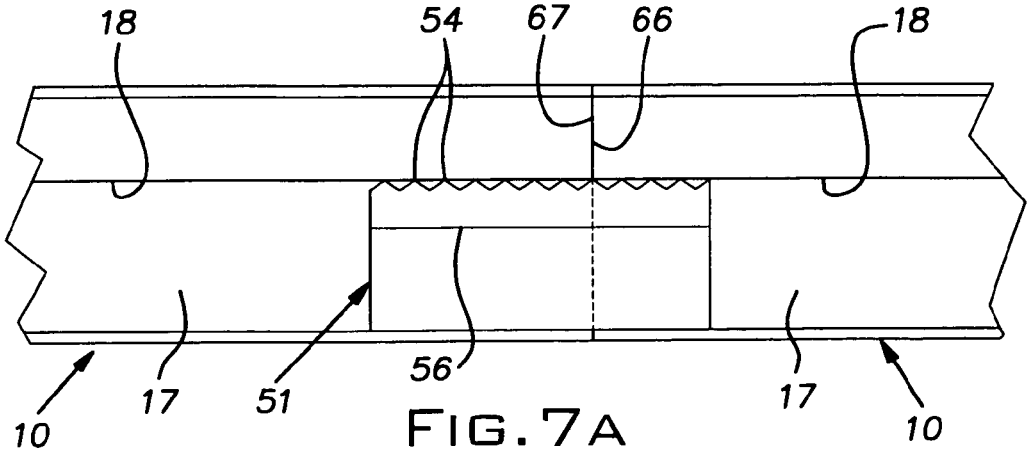
FIG. 7A is a view similar to FIG. 7 showing the splice used in a straight butt joint.
Figure 7:
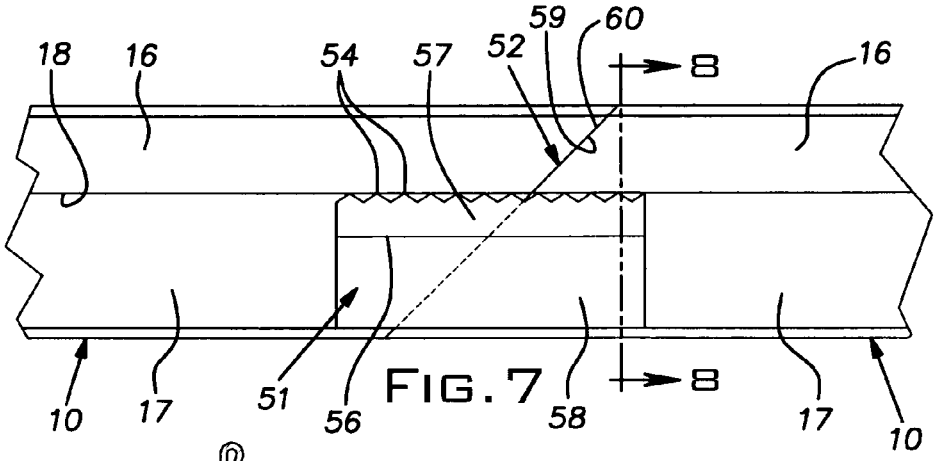
FIG. 7 is a fragmentary plan view of two lengths of the wall molding arranged in a straight line joint and maintained in alignment with a splice.
Figure 8:
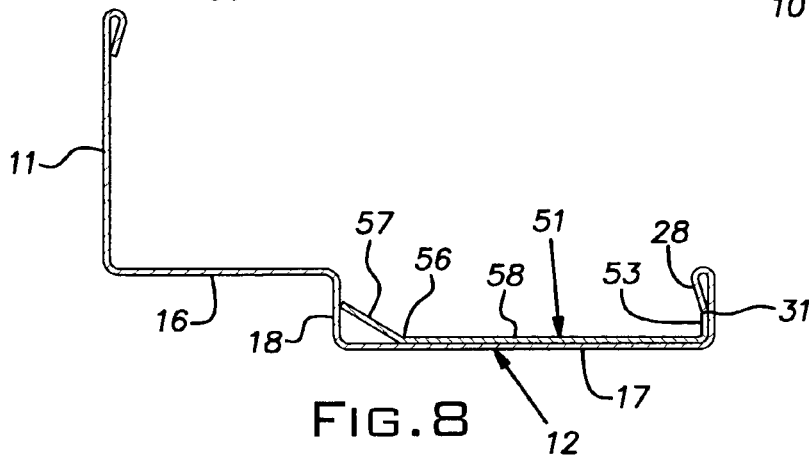
FIG. 8 is a cross-sectional view of the joint of FIG. 7 taken in the plane indicated by the lines 8-8 in FIG. 7.

FIGS. 7 and 8 illustrate a manner by which the ends of two abutting pieces of wall molding 10 are maintained in alignment at the horizontal legs 12. A specially formed separate splice 51 is provided to bridge the joint, designated by the numeral 52, and constrain the horizontal sections 12 to a common plane. The illustrated splice 51 is a sheet metal stamping of generally rectangular form. One of the long edges of the splice 51 has a relatively short vertical flange 53 while the opposite long edge is serrated to form a series of teeth 54. The splice 51 is slightly bent at a line 56 through a small angle so that a portion 57 carrying the teeth 54 is in a plane obtuse to the plane of the remaining portion 58. The splice 51 is proportioned so that the flange 53 fits vertically tightly under the edge 31 of the hem 28. When the splice flange 53 is against the wall molding flange 26, the splice 51 is proportioned so that the teeth 54 fit tightly and grip an opposing face of the vertical web 18. In use, the splice 51 is positioned as indicated in FIG. 7 so that it bridges the actual joint 52 between the abutting pieces of wall molding 10. The flange 53 is positioned under the hem edges 31 and splice teeth 54 are pressed downwardly until the teeth firmly grip the web faces. The bend 56 allows the splice 51 to resiliently deform by increasing the bend angle so as to account for dimensional variations in the individual wall molding pieces and/or the splice and to allow the splice to be retained in place with a spring-like action. The splice 51, when it is in place, as described, because the flange 53 is straight and tight fitting, forces the free edges of the abutting wall molding pieces 10 into mutual alignment. FIG. 7A illustrates the use of the splice 51 at a butt joint between two lengths of wall molding 10 that are abutted at their ends 66, 67 which lie in planes transverse to their longitudinal directions.

Figure 3:
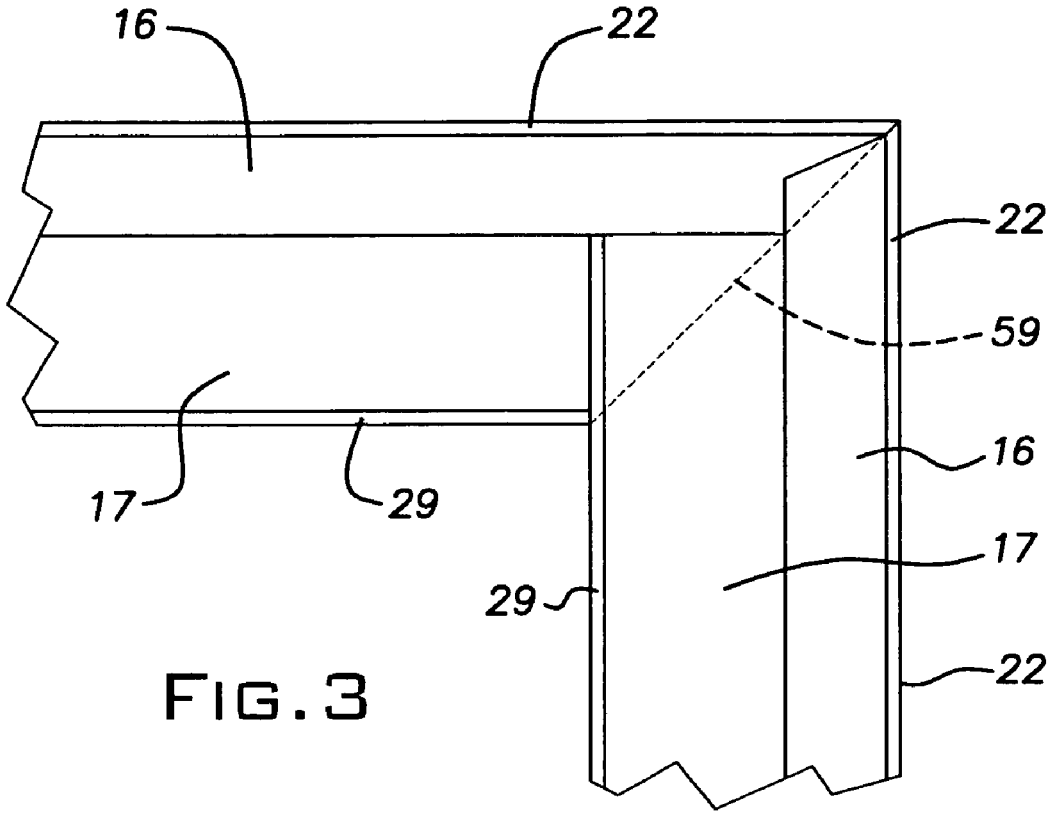
FIG. 3 is a fragmentary plan view of an inside corner of two pieces of the wall molding.

As indicated in FIG. 1, for example, the wall molding 10 can be factory produced with angled ends 59, 60. More specifically, the horizontal legs 12 can be formed with ends 59, 60 that are cut diagonally to the longitudinal direction of the molding 10, most commonly, at a nominal 45 degree angle with the ends parallel to one another so as to give the horizontal leg 12 in plan view a rhomboid shape. This style of factory end facilitates field construction of inside and outside miter joints. One end 59 of the molding 10 is suitable for use at inside corners, while the opposite end 60 is suitable for outside corners. FIG. 3 illustrates an inside corner in plan view. A mating piece of wall molding 10 is specially field cut at its end preferably by using a template 61. The template 61, which in the disclosed embodiment is double ended, can be supplied by the factory for use by the installer. The template 61 with the proper end orientation, is saddled over the wall molding piece to be cut, lines are scribed according to the edges of template end 62, and the piece is cut on the scribed lines, typically with aviation cutters or tin snips. The resulting geometry of the end cut on the mating piece 10 enables it to overlie portions of the factory edge 59 and rest on upper surfaces of the horizontal sections 16, 17 of the horizontal leg 12 at the factory edge. The result is a faux miter joint where the factory edge 59 is essentially the only edge that is visible from below the ceiling.

Figure 4:
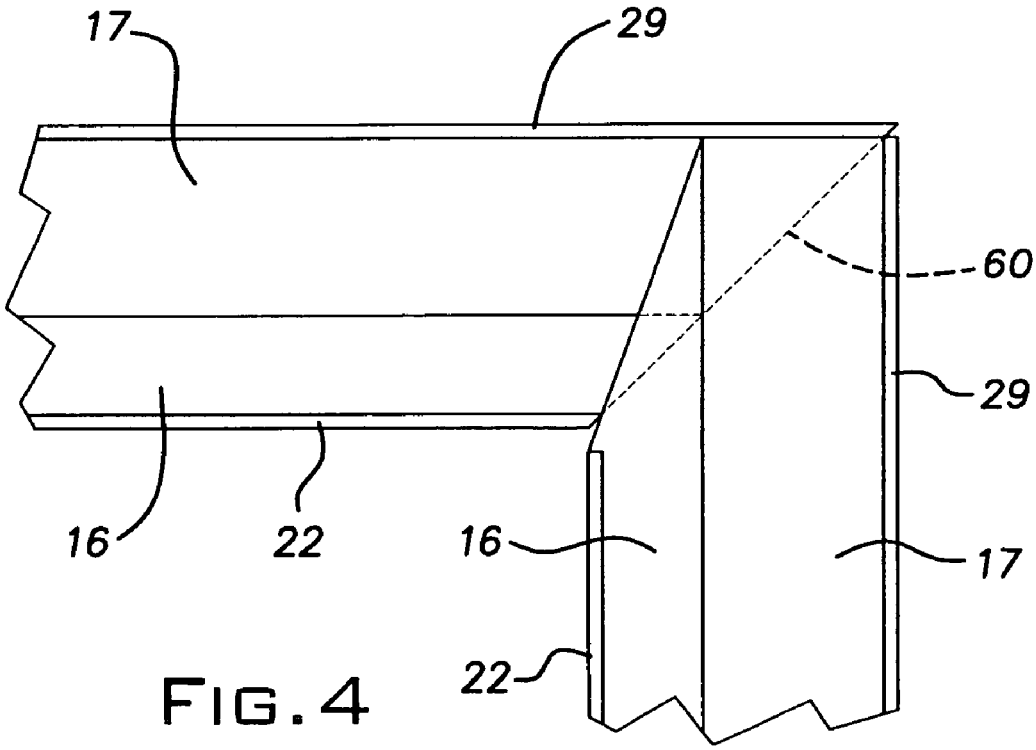
FIG. 4 is a fragmentary plan view of an outside corner of two pieces of the wall molding.
Figure 5:
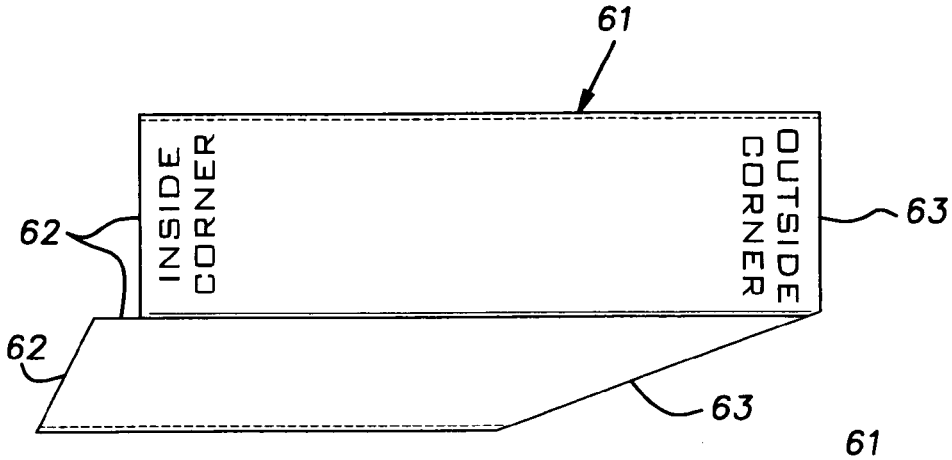
FIG. 5 is a plan view of a template for cutting the wall molding for inside and outside corners.
Figure 6:
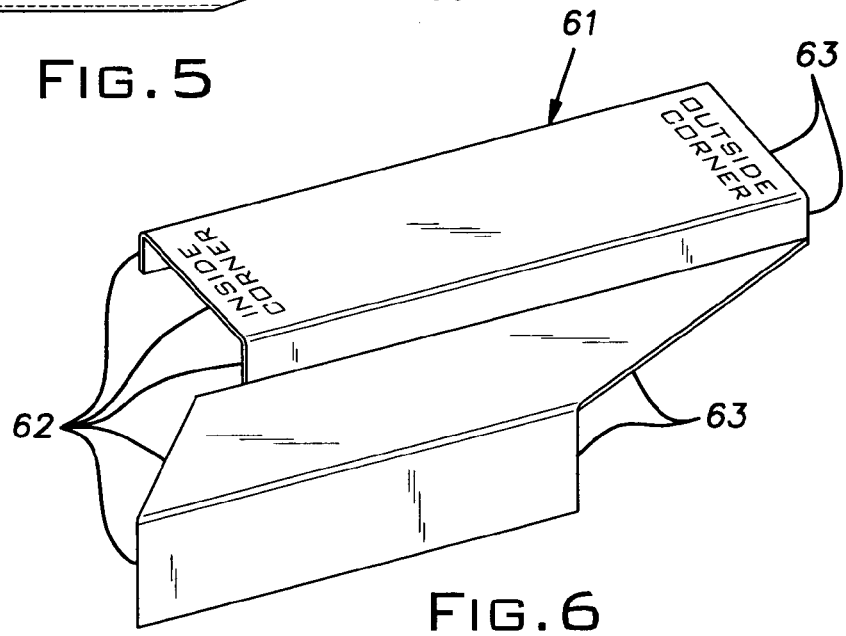
FIG. 6 is a perspective view of the template of FIG. 5.

FIG. 4 illustrates the construction of an outside joint in essentially the same manner as that described for the inside joint of FIG. 3. The opposite end, designated 63, of the template 61, is used to fashion the end of the mating piece 10 so it overlies the factory cut edge 60. The faux miter joints shown in FIGS. 3 and 4 produced in the manner described are of high quality since, for the most part, the only visible sight lines at the joint are the factory cut edges 59, 60 and these factory sight lines are unaffected by slight angular, longitudinal or lateral misalignments between the joined pieces.

Figure 10:
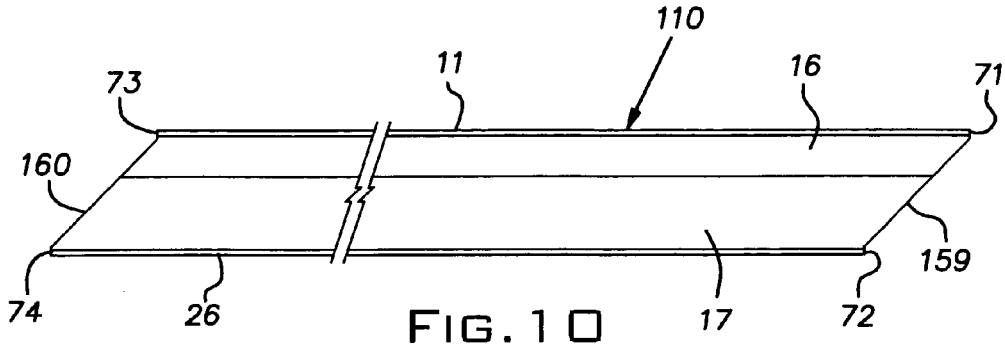
FIG. 10 is a view similar to FIG. 1 showing a modified form of the wall molding having blunted ends.
Figure 11:
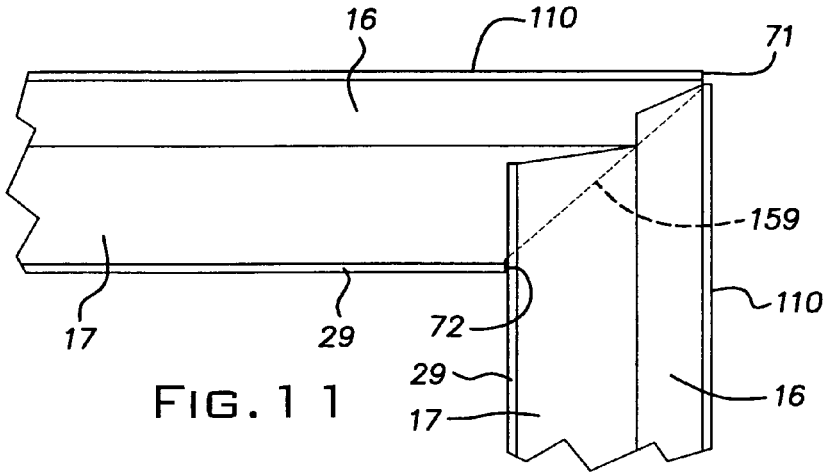
FIG. 11 is a fragmentary plan view similar to FIG. 3, showing an inside corner of two pieces of the wall molding of FIG. 10.
Figure 12:
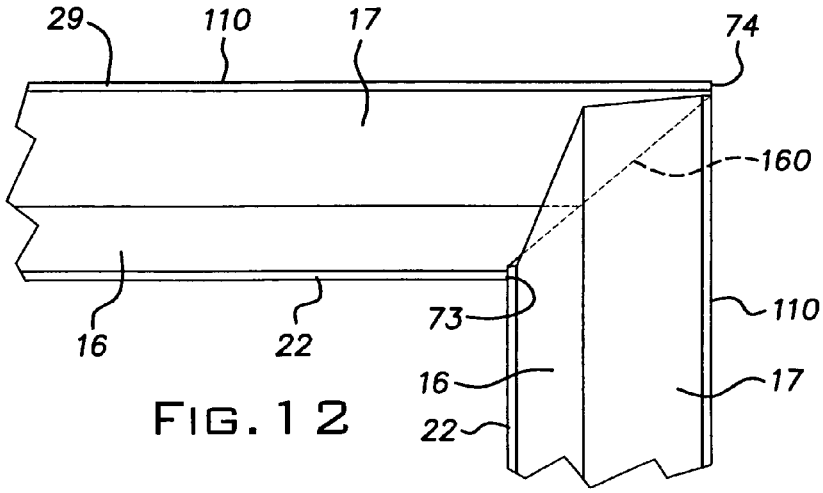
FIG. 12 is a fragmentary plan view similar to FIG. 4, showing an outside corner of two pieces of the wall molding of FIG. 10.

FIGS. 10-12 illustrate a modified form of the wall molding 110 in which the ends are blunted. The same numerals are used to designate the same parts of the molding 110 as described in connection with the molding 10. As shown in FIGS. 10-12, tips 71, 72, 73 and 74, i.e. primarily the vertical leg 11 and the vertical stiffening flange 26 are cut at right angles to the longitudinal direction of the wall molding 110. Factory miter edges 159 and 160 are at a nominal 45 degrees to the longitudinal direction of the wall molding. This angle can vary up to about 48 degrees, measured from a plane perpendicular to the longitudinal direction of the molding, to improve the fit and appearance of the faux miter joint. A modified template, corresponding to the template 61, can be provided to accommodate these changes.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A wall molding formed of an elongated metal body comprising a generally planar vertical leg and a generally horizontal leg integral with the vertical leg, the legs having a thickness substantially less than their respective vertical and horizontal widths, the legs intersecting and being joined at a longitudinally extending corner with the vertical leg extending upwardly from the horizontal leg, the horizontal leg having a longitudinally extending stiffening element adjacent a free edge spaced from the corner, the stiffening element being generally vertically disposed and extending vertically a distance substantially greater than the thickness of the horizontal leg, the width and configuration of the horizontal leg being arranged to support a grid tee at a distance of about at least 2" from a wall on which the molding is mounted with the vertical leg against the wall, the vertical stiffening element being effective to resist extensive buckling or bending deformation of a free edge of the horizontal leg remote from the corner when the vertical leg is secured against a non-flat wall and is thereby distorted, the shapes of the vertical and horizontal legs both being capable of being formed from a single strip of metal, being free of double layers in areas remote from their longitudinal edges, and being free of locations where the metal diverges in more than two directions whereby it can be easily field cut to length by hand using aviation shears, tin snips or like cutting tools.

2. A wall molding as set forth in claim 1, wherein the stiffening element is arranged to support a horizontal grid tee of a suspended ceiling system.

3. A wall molding as set forth in claim 1, wherein the stiffening element rises vertically from adjacent areas of the horizontal leg.

4. A wall molding as set forth in claim 1, wherein said horizontal leg has two horizontal sections separated by a vertical web, the vertical web serving to assist the vertical stiffening element in resisting buckling or bending so as to maintain the free edge of the horizontal leg substantially straight.

5. A wall molding formed of an elongated metal body comprising a generally planar vertical leg and a generally horizontal leg integral with the vertical leg, the legs having a thickness substantially less than their respective vertical and horizontal widths, the legs intersecting and being joined at a longitudinally extending corner, the horizontal leg having a longitudinally extending stiffening element spaced from the corner, the stiffening element being generally vertically disposed and extending vertically a distance substantially greater than the thickness of the horizontal leg, the width and configuration of the horizontal leg being arranged to support a grid tee at a distance of about at least 2" from a wall on which the molding is mounted with the vertical leg against the wall, the vertical stiffening element being effective to resist extensive buckling or bending deformation of a free edge of the horizontal leg remote from the corner when the vertical leg is secured against a non-flat wall and is thereby distorted, the stiffening element being a vertical flange adjacent the free edge of the horizontal leg, the shapes of the vertical and horizontal legs both being capable of being formed from a single strip of metal, being free of double layers in areas remote from their longitudinal edges, and being free of locations where the metal diverges in more than two directions whereby it can be easily field cut to length by hand using aviation shears, tin snips or like cutting tools.

6. A wall molding comprising a roll formed elongated sheet metal body having a generally planar vertical leg and a relatively wide generally horizontal leg integral with the vertical leg, the legs having a thickness substantially less than their vertical and horizontal widths, the legs intersecting and being joined at a longitudinally extending corner, the horizontal leg having two substantially horizontal sections joined by a substantially vertical web integral with said sections, the horizontal leg having a longitudinally extending stiffening flange at a free edge distal from the corner, the stiffening flange being generally vertically disposed and extending vertically a distance substantially greater than the thickness of the horizontal leg, the width and configuration of the horizontal leg being arranged to support a grid tee at a distance of at least 2" from a wall on which the molding is mounted with the vertical leg abutted against the wall, the vertical stiffening flange being effective to resist extensive buckling or bending deformation of the free edge of the horizontal leg when the vertical leg is secured against a non-flat wall and is thereby distorted, the shapes of the vertical and horizontal legs both being capable of being roll formed from a single strip of metal, being free of double layers in areas remote from their longitudinal edges, and being free of locations where the metal diverges in more than two directions whereby it can be easily field cut to length by hand using aviation shears, tin snips or like cutting tools.

7. A wall molding as set forth in claim 6, wherein said flange is integral with and extends upwardly from one of said horizontal sections remote from said corner adjacent a free edge of said one section remote from said corner.

8. A wall molding as set forth in claim 6, wherein said stiffening flange includes a hem along an upper edge thereof.

9. A wall molding as set forth in claim 6, wherein its ends are parallel factory cut at 45 degrees to facilitate field installation of the wall molding at inside and outside corners by permitting one or the other end to form a faux miter joint with another piece of molding with the same cross-sectional shape as said wall molding and trimmed so that its end edges at horizontal sections overlie and are hidden by the horizontal sections of the wall molding piece carrying the factory end.

10. A suspended ceiling system comprising a grid of tees, ceiling tiles supported on the tees, a wall molding supporting the tees and the tiles adjacent a wall on which the wall molding is secured, the wall molding being formed of an elongated metal body comprising a generally planar vertical leg and a generally horizontal leg integral with the vertical leg, the legs having a thickness substantially less than their respective vertical and horizontal widths, the legs intersecting and being joined at a longitudinally extending corner, the horizontal leg having a longitudinally extending stiffening element adjacent a free edge spaced from the corner, the stiffening element being generally vertically disposed a distance substantially greater than the thickness of the horizontal leg, the width and configuration of the horizontal leg being arranged to support the grid tees at a distance of about at least 2" from the wall on which the wall molding is mounted with the vertical leg abutted against the wall, the vertical stiffening element being effective to resist excessive buckling or bending deformation of a free edge of the horizontal leg remote from the corner when the vertical leg is secured against a non-flat wall and is thereby distorted, the shape of the vertical and horizontal legs being capable of being formed from a single strip of metal free of double layers in areas remote from its longitudinal edges whereby it can be easily field cut to length by hand using aviation shears, tin snips or like cutting tools.

11. A suspended ceiling system as set forth in claim 10, wherein two lengths of said wall molding are abutted end-to-end to form a straight-line joint, a sheet metal splice bridging said joint, the splice being assembled on upper surfaces of the abutted wall moldings, the splice being compressed between two spaced vertical elements of each of said abutted wall moldings.

12. A suspended ceiling system as set forth in claim 11, wherein the splice is a sheet metal element bent out of a plane to accommodate dimensional variations between said wall moldings and said splice.

13. A suspended ceiling system as set forth in claim 11, wherein said splice is formed with teeth along one edge to securely grip one of said vertical elements.

14. A method of facilitating the installation of elongated sheet metal shadow-type wall molding for suspended ceiling systems comprising the steps of forming sheet metal strips into moldings with vertical and horizontal legs such that the horizontal leg includes portions lying in different horizontal planes integrally interconnected with one another such that it is difficult to cut the horizontal legs with hand-operated aviation shears, tin snips or like cutting tools and forming lengths of the molding with factory end cuts generally in planes at 45 degrees to the longitudinal direction of the molding in plan view and generally perpendicular to the planes of the horizontal portions, the planes of the cuts at 45 degrees at opposite ends of a molding being parallel to one another such that the molding has a rhomboid shape in plan view.

15. A method of facilitating the installation of elongated sheet metal shadow-type wall molding for suspended ceiling systems comprising the steps of forming sheet metal strips into moldings with vertical and horizontal legs such that the horizontal leg includes portions lying in different horizontal planes integrally interconnected with one another such that it is difficult to cut the horizontal legs with hand-operated aviation shears, tin snips or like cutting tools and forming lengths of the molding with factory end cuts generally in planes at 45 degrees to the longitudinal direction of the molding and generally perpendicular to the planes of the horizontal portions, a template is provided with quantities of the wall molding being distributed from the factory for use by an installer in the field making a miter joint, the template allowing the molding to be marked to enable it to be appropriately cut so that the field cut end overlies one or the other factory ends of a mating piece of molding.

16. A method as set forth in claim 15, wherein the template is produced in double-ended form with one end being shaped to correspond to an inside corner and the other end being shaped to correspond to an outside corner.

* * * * *

UNITED STATES PATENT AND TRADEMARK OFFICE

CERTIFICATE OF CORRECTION

PATENT NO. : 7,578,106 B2
APPLICATION NO. : 10/887190
DATED : August 25, 2009
INVENTOR(S) : Burns et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1447 days.

Signed and Sealed this

Seventh Day of September, 2010

David J. Kappos

David J. Kappos
*Director of the United States Patent and Trademark Office*